US010261467B2

(12) United States Patent
Seto

(10) Patent No.: US 10,261,467 B2
(45) Date of Patent: Apr. 16, 2019

(54) IMAGE FORMING APPARATUS

(71) Applicant: CANON KABUSHIKI KAISHA, Tokyo (JP)

(72) Inventor: Masaki Seto, Gotemba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/791,779

(22) Filed: Oct. 24, 2017

(65) Prior Publication Data

US 2018/0120765 A1 May 3, 2018

(30) Foreign Application Priority Data

Oct. 31, 2016 (JP) ..... 2016-213277

(51) Int. Cl.

| | |
|---|---|
| ***G03G 15/00*** | (2006.01) |
| ***G03G 21/18*** | (2006.01) |
| ***G03G 21/16*** | (2006.01) |
| *G03G 15/01* | (2006.01) |

(52) U.S. Cl.
CPC ..... *G03G 21/1842* (2013.01); *G03G 21/1633* (2013.01); *G03G 15/0136* (2013.01)

(58) Field of Classification Search
CPC ..... G03G 21/1633; G03G 2221/1684; G03G 21/1647; G03G 21/1623; G03G 21/1853
USPC ..... 399/110
See application file for complete search history.

(56) References Cited

U.S. PATENT DOCUMENTS

| | | | | |
|---|---|---|---|---|
| 8,135,305 | B2 * | 3/2012 | Kotsuka | G03G 21/185 399/111 |
| 2007/0147887 | A1 * | 6/2007 | Hattori | G03G 21/1623 399/119 |
| 2015/0001794 | A1 * | 1/2015 | Doi | B65H 1/04 271/264 |

FOREIGN PATENT DOCUMENTS

JP 4883818 B2 2/2012

* cited by examiner

*Primary Examiner* — Walter L Lindsay, Jr.
*Assistant Examiner* — Frederick Wenderoth
(74) *Attorney, Agent, or Firm* — Venable LLP

(57) ABSTRACT

A cartridge has a surface to be biased which is connected to a first surface extending in an intersecting direction that intersects with an insertion direction from an upstream side to a downstream side in the insertion direction, and an engaging portion engaging with a support member that supports the cartridge inside a main body and has a biasing member that biases an engaged portion to be engaged with the engaging portion in the intersecting direction. The engaged portion has a biasing surface extending in the intersecting direction from the upstream side to the downstream side in the insertion direction. Movement of the support member in the intersecting direction by the closing operation of an opening and closing member, the surface to be biased is biased by the biasing surface, the cartridge contacts with a positioning portion, and positioning of the cartridge is performed.

8 Claims, 7 Drawing Sheets

IMAGE FORMING APPARATUS

BACKGROUND OF THE INVENTION

Field of the Invention

The present invention relates to an electrophotographic image forming apparatus in which a process cartridge can be detachably attached.

Description of the Related Art

Various configurations of an electrophotographic image forming apparatus of a process cartridge type (referred to hereinbelow as an image forming apparatus) have been suggested, in which a mechanism for attaching and detaching a process cartridge (referred to hereinbelow as a cartridge) is reduced in size and a user operation force is reduced such that user operability is improved. For example, a configuration has been suggested in which a biasing member is provided to a movable guide rail on which a cartridge is placed, and by lifting or lowering the movable guide rail, the cartridge is lifted or lowered inside the apparatus main body to be abutted against a main body frame and positioned (Japanese Patent No. 4,883,818).

In this configuration, the operation of lifting and lowering the cartridge is interlocked with an opening and closing operation of a door accessed for mounting the cartridge. The cartridge includes, for example, a drive coupling for driving a photosensitive member and a developing roller, and an electrical contact portion for supplying a bias to a charging unit and a developing unit, the drive coupling and the electrical contact portion being located on the back surface (driving side) of the cartridge when the cartridge is mounted into the apparatus main body. These drive coupling, electrical contact portion and the like enable, for example, driving connection to the apparatus main body side and contact with electrical contacts thereon. Such a configuration in which the door of the apparatus main body and the movable guide rail are interlocked allows the user to mount the cartridge only by inserting the cartridge longitudinally into the apparatus main body and closing the door and makes it possible to improve user operability.

However, in some recently developed configurations, a plurality of electrical contacts is needed for one cartridge in order to control various cartridges, and there are configurations in which a reaction force from the apparatus main body which is due to a spring contact pressure is applied to the cartridge in the take-out direction thereof. Further, there are many configurations in which a plurality of drive couplings is used and a spring reaction force required for the coupling engagement thereof is received. Furthermore, a cartridge is sometimes configured to be connected on the back side thereof to the conveying path of the apparatus main body in order to convey the waste toner or the like generated when a photosensitive drum is cleaned from the cartridge to the apparatus main body. In this case, a spring-type shutter mechanism or the like is widely used to prevent waste toner from spilling when the cartridge is taken out. The reaction force of the spring biasing force of this shutter mechanism is received by the cartridge. These configurations are widely used to meet the diversified needs for the image forming apparatuses and reduce the apparatus main body in size.

In the configuration in which the opening and closing of the door and the movable guide rail are interlocked with each other, a large drawing-in force opposed to the reaction force is needed so that the positioning of the cartridge in the longitudinal direction could be reliably performed by the reaction force acting in the direction of mounting and demounting the cartridge on and from the apparatus main body. Regarding this drawing-in force, for example, in Japanese Patent No. 4,883,818, a biasing force of a drawing-in spring is applied to a drawing-in lever, and the drawing-in lever is engaged with the cartridge so that the back side of the cartridge abuts against the positioning section of the frame. In the process of inserting the cartridge, it is necessary for the user to rotate the drawing-in lever up to a predetermined angle, and the force for charging the biasing force of the drawing-in spring is generated by the operation of the user.

Here, as described above, the reaction force with respect to the cartridge mounting direction is likely to be further increased by the interface configuration between the cartridge and the apparatus main body such as the drive coupling configuration, the increase in the number of electrical contacts, or waste toner conveying coupling on the rear side of the cartridge. Since the biasing force of the drawing-in spring or the like for compensating the reaction force also increases, the force for charging the biasing force of the drawing-in spring also increases. This results in the increase in the operation force when the user mounts the cartridge. Meanwhile, in the case where the longitudinal biasing mechanism of the cartridge including the above-mentioned drawing-in lever or drawing-in spring is not used, an insufficient mounting state may occur in which the cartridge is not mounted by the user operation to the predetermined positioning position in the longitudinal direction. Where the apparatus operates in the insufficient mounting state, there is a concern that troubles, problems and failures such as a connection failure of the drive coupling and failed conduction in electrical contacts will occur.

It is an object of the present invention to provide a technique that enables a user to mount a cartridge reliably on an apparatus main body in an easy manner and with a small operation force.

SUMMARY OF THE INVENTION

In order to attain the above object, the image forming apparatus of the present invention comprises:

an apparatus main body;

a cartridge that can be detachably attached to an interior of the apparatus main body;

an opening and closing member provided at the apparatus main body so as to open and close the interior;

a positioning portion having a regulation surface that extends in an intersecting direction intersecting with an insertion direction of the cartridge in the interior, comes into contact with the cartridge and regulates a position of the cartridge in the insertion direction; and a support member that supports the cartridge, that is moved in the intersecting direction from a first position, in which the cartridge is retracted from a position in which an image can be formed, in conjunction with a closing operation of the opening and closing member, and that can be moved to a second position in which the cartridge is positioned at the position in which an image can be formed, wherein the cartridge has an engaging portion that engages with the support member, the engaging portion has a first surface extending in the insertion direction and a surface to be biased which is connected to the first surface and extends in the intersecting direction from an upstream side to a downstream side in the insertion direction, the support member has an engaged portion which is to be engaged with the engaging portion and a biasing member biasing the engaged portion in the intersecting direction, the engaged portion has a biasing surface extending in the intersecting direction from the upstream side to the downstream side in the insertion direction, and as a result of moving the support member in the intersecting direction by the closing operation, the surface to be biased is biased by the biasing surface, the cartridge is brought into contact with the positioning portion, and positioning of the cartridge is performed.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

Figure 1:
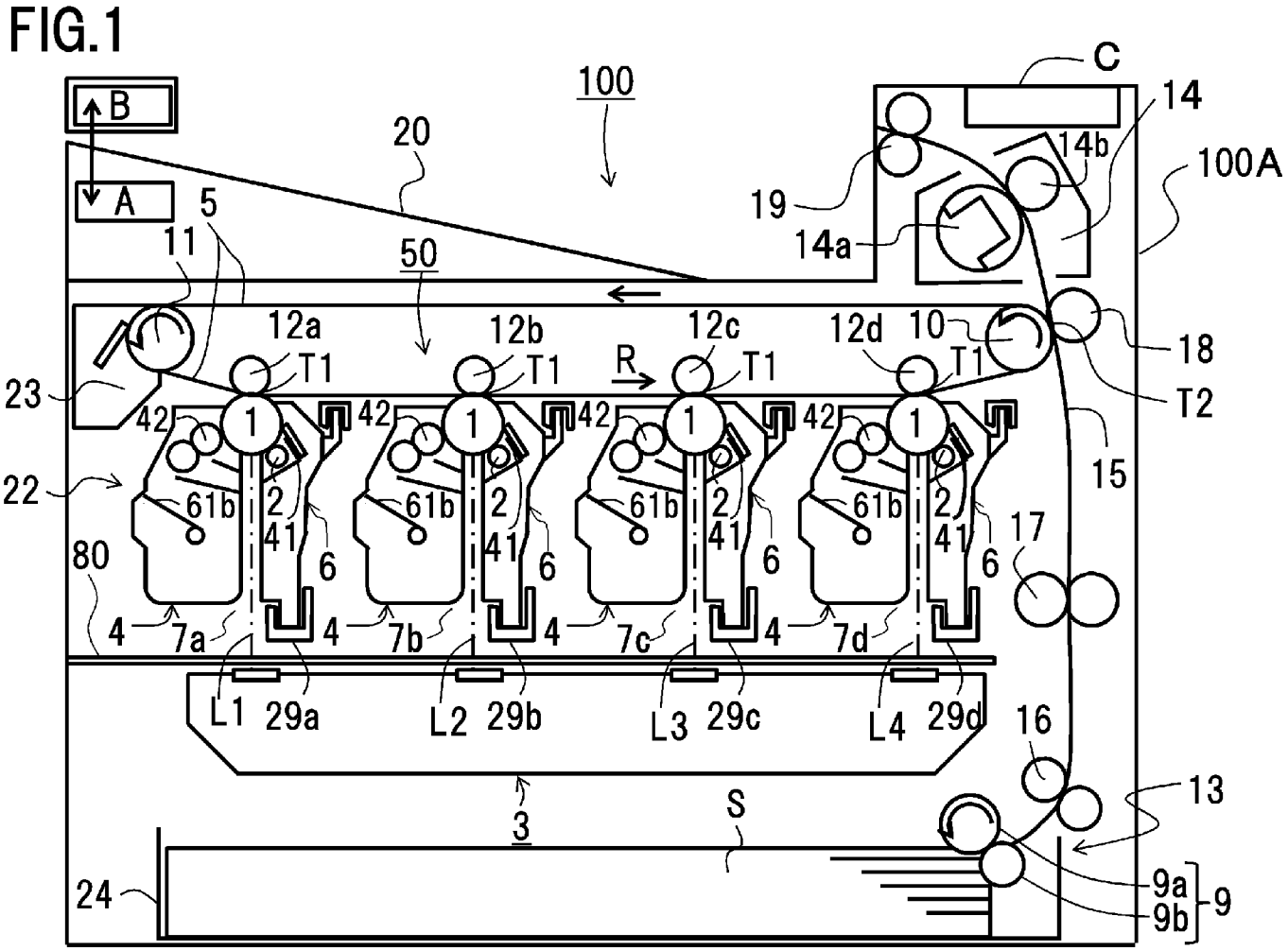
FIG. 1 is a schematic cross-sectional view of an image forming apparatus according to an example of the present invention.
Figure 2A:
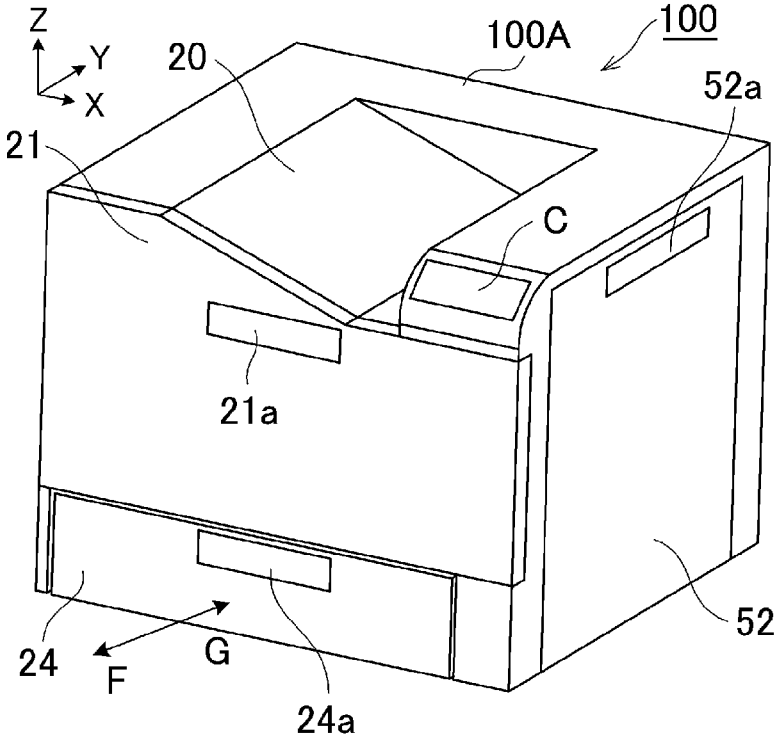
FIGS. 2A and 2B are schematic external perspective views of the image forming apparatus according to an example of the present invention.
Figure 2B:
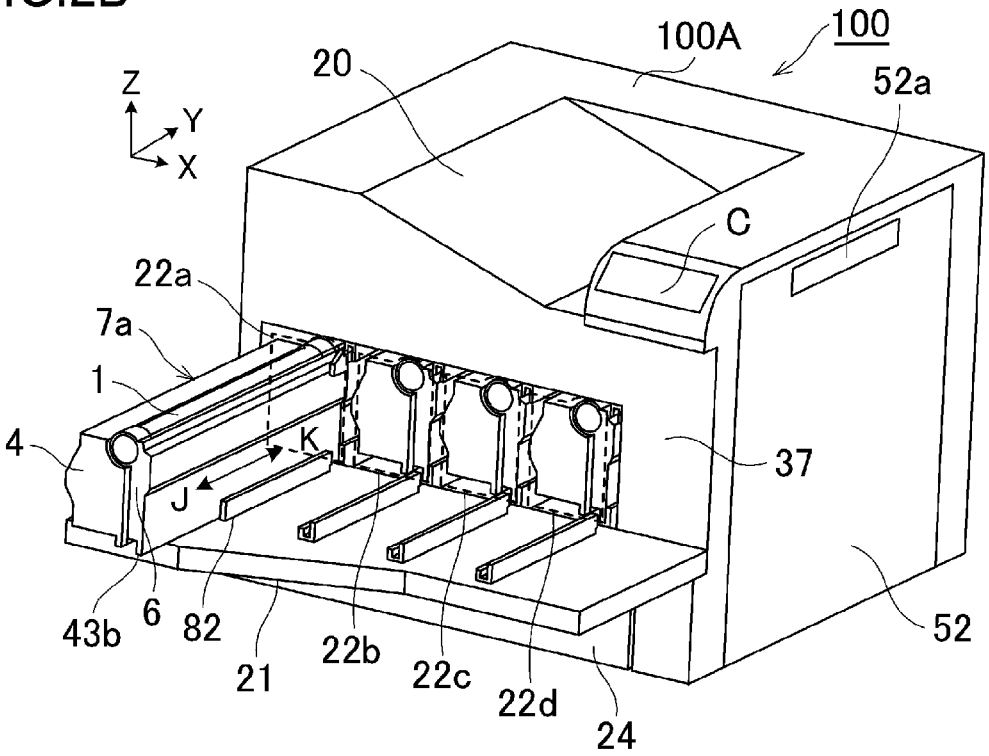

FIG. 1 is a schematic vertical sectional view of an image forming apparatus 100 according to Example 1 of the present invention, showing the cross section of the image forming apparatus in an image forming operation state. FIGS. 2A and 2B are external perspective views of the image forming apparatus. FIG. 2A is an external perspective view of the image forming apparatus 100 in a state where a front door 21 capable of opening and closing the interior of the apparatus main body is closed. FIG. 2B shows a state where the front door 21 is open and a first process cartridge 7*a* (abbreviated hereinbelow as a cartridge for the sake of brevity) is being inserted to or drawn out from the apparatus main body 100A.

The image forming apparatus 100 of the present embodiment is a four-color full-color laser beam printer (color image forming apparatus) using an electrophotographic process. That is, an image is formed on a sheet-shaped recording material S (paper, OHP sheet, label, etc.) on the basis of an electrical image signal inputted from an external host device B such as a personal computer-image reader to a control circuit unit (control means: CPU) A. The control circuit unit A exchanges various kinds of electrical information with the external host device B and an operation unit C and controls the image forming operation of the image forming apparatus 100 in a comprehensive manner according to a predetermined control program or a reference table.

The image forming apparatus 100 is configured to use a plurality of cartridges (four, first to fourth, cartridges 7 (7*a* to 7*d*) in the image forming apparatus of the present example) which are detachably attached to the apparatus main body 100A. By opening the door 21 of the apparatus main body 100A and opening the front side of the apparatus main body 100A, as shown in FIG. 2B, the cartridges 7 can be independently attached to and detached from respective cartridge mounting units 22 (22*a*, 22*b*, 22*c*, 22*d*). Each of the cartridges 7 is configured to be inserted into the cartridge mounting unit 22 with its longitudinal direction oriented in the front-rear direction, so that the image formation by the cartridge 7 could be interlocked with the operation of closing the door 21. In the explanation herein, it is assumed that the side opposite to the front side (forward side) where the door 21 of the apparatus main body 100A is provided is the rear side (back side). That is, the front-rear direction from the front side to the back side, or the direction from the back side to the front side is the longitudinal direction of the cartridge 7. Further, in the explanation herein, it is assumed that the left side and the right side are defined as seen from the position facing the front of the apparatus main body 100A where the door 21 is provided. It is to be noted that the apparatus main body 100A refers to a constitutional part excluding the cartridge in the configuration of the image forming apparatus.

Configuration of Cartridge

Figure 3:
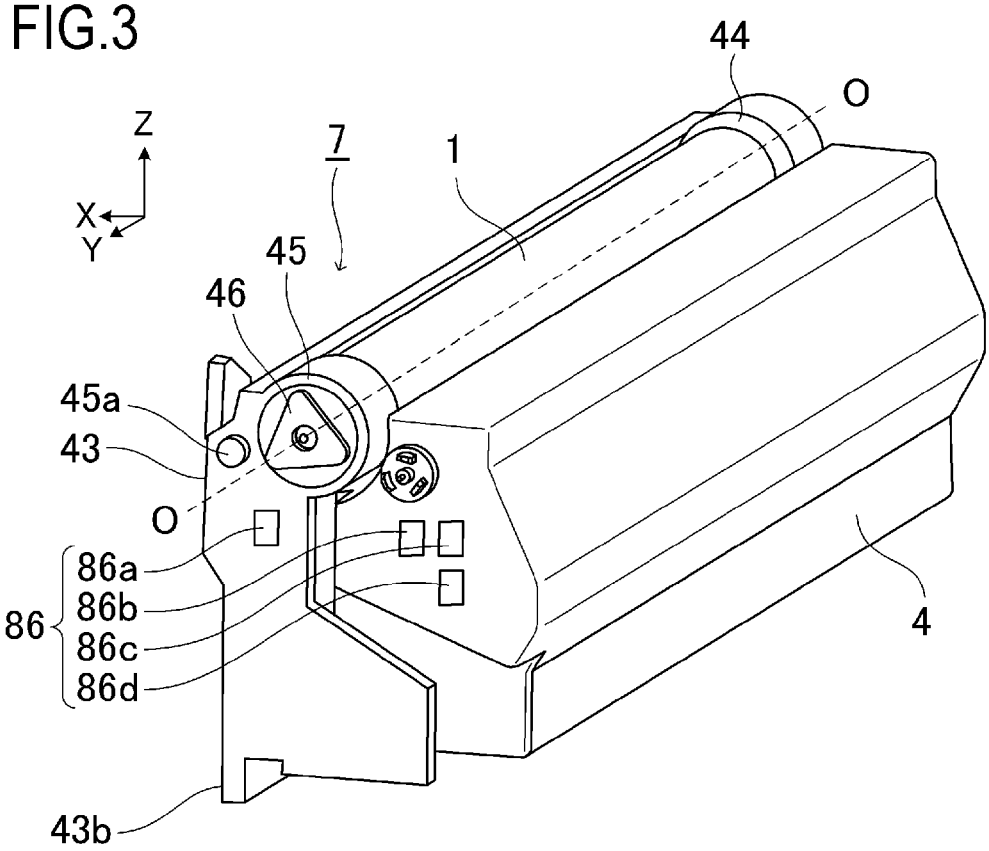
FIG. 3 is a schematic perspective view of a process cartridge in an example of the present invention.
Figure 4:
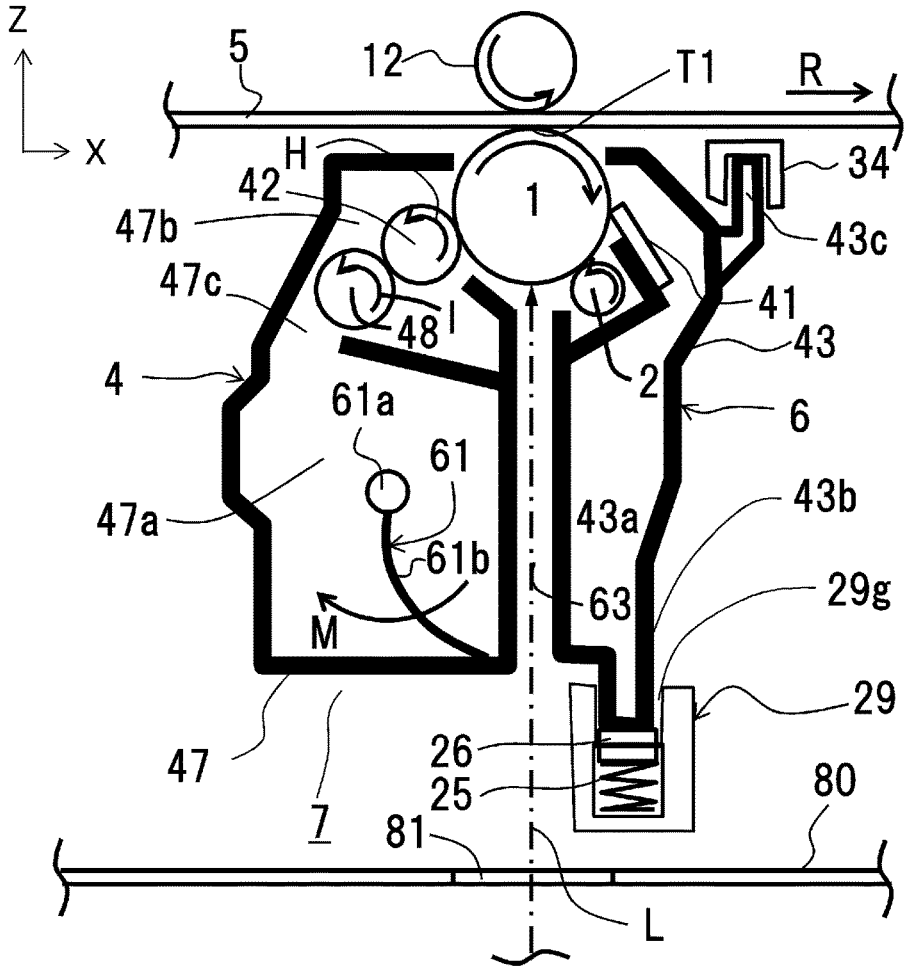
FIG. 4 is a schematic cross-sectional view of an apparatus main body in the vicinity of a process cartridge in an example of the present invention.

The cartridge 7 in this example will be described with reference to FIGS. 3 and 4. The first to fourth cartridges 7 (7*a* to 7*d*) have the electrophotographic process mechanism of the same configuration, except for the color of the developer (referred to hereinbelow as toner) accommodated in the toner accommodating chamber of the developing unit 4. In the image forming apparatus of this example, a yellow (Y) toner is accommodated in the toner accommodating chamber of the developing unit 4 in the first cartridge 7*a*. A magenta (M) toner is accommodated in the toner accommodating chamber of the developing unit 4 in the second cartridge 7*b*. A cyan (C) toner is accommodated in the toner accommodating chamber of the developing unit 4 in the third cartridge 7*c*. A black (K) toner is accommodated in the toner accommodating chamber of the developing unit 4 in the fourth cartridge 7*d*. FIG. 3 is a schematic external perspective view of the cartridge 7 taken from the rear side (drive side) in the mounting direction. FIG. 4 is a partial schematic cross-sectional view of the cartridge 7 mounted at a position where an image can be formed (predetermined mounting position) in the apparatus main body 100A, and the surroundings of the cartridge.

The cartridge 7 is an assembly in which the direction O-O of the rotation axis (FIG. 3) of the drum 1 is the longitudinal direction. The cartridge has a photosensitive member unit 6 and a developing unit 4. The photosensitive member unit 6 is configured of a drum 1 as an electrophotographic photosensitive member, a charging roller (charging means) 2 as process means acting on the drum 1, and a cleaning member 41 for cleaning the peripheral surface of the drum 1, these component being assembled with a cleaning frame 43. In the developing unit 4, a developing roller 42 as a developer bearing member is assembled with a developing frame 47. The developing frame 47 of the developing unit 4 and the cleaning frame 43 of the photosensitive member unit 6 are integrally joined to each other to form the cartridge 7.

In the photosensitive member unit 6, the drum 1 is rotatably attached through bearing members 44, 45 on the front side and the back side of the cleaning frame 43. The charging roller 2 and the cleaning member 41 are arranged on the periphery of the drum 1. The charging roller 2 is kept in contact with the drum 1 by a predetermined pushing force and rotates following the rotation of the drum 1. The cleaning member 41 is kept in contact with the drum 1 by a predetermined pushing force. The residual toner removed from the surface of the drum 1 by the cleaning member 41 falls into a removed toner chamber 43*a*. A drive input coupling (drive receiving unit) 46 is provided at an end portion on the back side of the cleaning frame 43 when viewed from the cartridge mounting direction.

Meanwhile, in the developing unit 4, the developing frame 47 is formed to include a toner accommodating chamber (developer accommodating unit) 47*a* for accommodating the toner as a developer, and a developing chamber 47*b* in which the developing roller 42 is arranged in contact with the drum 1 and rotates in the direction of an arrow H. The developing chamber 47*b* is disposed above the toner accommodating chamber 47*a*, and the toner accommodating chamber 47*a* and the developing chamber 47*b* communicate with each other at an opening 47*c* located above the toner accommodating chamber 47*a*. Further, in the developing chamber 47*b*, a toner supply roller 48 as a developer supply member is arranged in contact with the developing roller 42 and rotates in the direction of an arrow I.

A rotatably supported toner agitating member 61 is provided in the toner accommodating chamber 47*a* in order to agitate the accommodated toner and send the toner through the opening 47*c* to the toner supply roller 48 of the developing chamber 47*b*. The toner agitating member 61 is configured of a shaft member 61*a* and a flexible resin agitating sheet 61*b* for agitating and conveying the toner, one end of the agitating sheet being attached to the shaft member 61*a*. The toner agitating member 61 is rotationally driven at a predetermined speed in the direction of an arrow M according to the image forming operation.

The cartridge 7 is provided with the drive input coupling 46 to which a drive output coupling (drive output unit: not shown) on the apparatus main body 100A side is coupled. The cartridge 7 is mounted at a position where an image can be formed in the apparatus main body 100A, and the driving force is transmitted from the drive output coupling to the drive input coupling 46. As a result, the drum 1, the developing roller 42, the toner supply roller 48, and the toner agitating member 61 can be rotationally driven in a predetermined rotation direction at a predetermined speed according to the image forming operation. Further, as shown in FIG. 3, input electrical contacts 86 (86*a*, 86*b*, 86*c*, 86*d*) are arranged on the side surface of the cartridge 7. These cartridge-side contacts are configured to be electrically connectable to the main body-side contacts, that is, the output electrical contacts (not shown) on the side of the apparatus main body 100A by mounting the cartridge 7 at the position where an image can be formed in the apparatus main body 100A. Further, in this configuration, the output electrical contacts can come into contact with the input electrical contacts, a predetermined bias can be applied from the output electrical contacts to the input electrical contacts, and predetermined charging bias and development bias of the charging roller 2 and the developing roller 42 can be applied according to the image forming operation.

Configuration of Apparatus Main Body

A laser scanner unit 3 as means for exposing image information of each cartridge 7 on the drum 1 is provided below the cartridge mounting unit 22 in the apparatus main body 100A. In the apparatus main body 100A, an intermediate transfer belt unit 50 is provided above the cartridge mounting unit 22. This unit 50 has a driving roller 10 disposed on the right side, a tension roller 11 disposed on the left side, and an intermediate transfer belt (referred to hereinbelow as a belt) 5 bridged between these rollers. The upper surface portion of the drum 1 of each cartridge 7 mounted at the position where an image can be formed is in contact with the lower surface of the belt 5. The contact portion is a primary transfer portion T1. Further, on the inside of the belt 5, first to fourth four primary transfer rollers 12 (12*a* to 12*d*), which face the drum 1 of each cartridge 7, with the belt 5 being interposed therebetween, are arranged in parallel in the left-right direction, the rotation axis direction thereof being taken as a front-rear direction. The belt 5 is moved in a circulating manner by the driving roller 10 in the counterclockwise direction of an arrow R at a speed corresponding to the rotational speed of the drum 1 in a state of contact with the upper surface portion of the drum 1 of each cartridge 7. A predetermined primary transfer bias is applied to each primary transfer roller 12 at a predetermined control timing. A secondary transfer roller 18 is disposed at a position facing the driving roller 10, with the belt 5 being interposed therebetween. The contact portion of the belt 5 and the secondary transfer roller 18 is the secondary transfer portion T2. A predetermined secondary transfer bias is applied to the secondary transfer roller 18 at a predetermined control timing. A transfer belt cleaning device 23 is disposed at a position facing the tension roller 11, with the belt 5 being interposed therebetween.

A recording material feeding device 13 is disposed in the lower portion of the apparatus main body 100A. The recording material feeding device 13 includes a feeding cassette 24 that accommodates the recording material (transfer material) S, a roller pair 9 of a feeding roller 9*a* and a retard roller 9*b*, and a conveying roller pair 16. Further, recording material conveying means is provided from the recording material feeding device 13 to the upper portion of the apparatus main body on the right side in the apparatus main body 100A. The recording material conveying means is composed of a registration roller pair 17, a secondary transfer portion T2, a fixing unit (fixing means) 14, and a discharge roller pair 19. The upper surface of the apparatus main body 100A is a discharge tray 20.

The feeding cassette 24 is put in and taken out from the apparatus main body 100A by front access. A grip portion 24*a* is disposed at the feeding cassette 24. Thus, the feeding cassette 24 can be pulled out to the front side of the apparatus main body 100A as shown by an arrow F in FIGS. 2A and 2B, and the user removes the feeding cassette 24 from the apparatus main body 100A and sets the recording material S into the feeding cassette 24. Replenishment of the recording material S is completed by inserting the feeding cassette 24 into the apparatus main body 100A as indicated by an arrow G in FIGS. 2A and 2B. The right surface side of the apparatus main body 100A is provided with a rotatably attached right surface door 52. By pulling a grip portion 52*a* at the right surface door 52, it is possible to open the conveying path for rotating the right surface door 52. As a result, when the recording material S jams, it is possible to secure a work space for removing the jammed recording material S.

The operation for forming a full color image is performed in the following manner. The control circuit unit A starts the image forming operation of the image forming apparatus on the basis of a print start signal. That is, the drums 1 of the first to fourth cartridges 7 (7*a* to 7*d*) are rotationally driven at a predetermined speed in the clockwise direction in FIG. 1 according to the image formation timing. The belt 5 is also rotationally driven in the counterclockwise direction shown by an arrow R (forward direction of rotation of the drum) at a speed corresponding to the speed of the drum 1. The laser scanner unit 3 is also driven. Synchronously with this driving, the surface of the drum 1 is uniformly charged to a predetermined polarity and potential by the charging roller 2 to which a predetermined charging bias is applied in each cartridge 7. The laser scanner unit 3 scans and exposes the surface of each drum 1 with laser beams L (L1 to L4) modulated in accordance with image information signals of Y, M, C and K colors. The laser beams L are emitted upward from first to fourth window portions 81 provided on the upper surface plate 80 of the laser scanner unit 3 (FIG. 4). The laser beams L (L1, L2, L3, L4) outputted from the laser scanner unit 3 are radiated onto the lower surface of the drum 1 through a slit opening 63. The slit opening 63 is a laser beam incident opening provided in a gap portion between the photosensitive member unit 6 and the developing unit 4 of the corresponding cartridge 7. As a result, an electrostatic latent image corresponding to the image information signal of the corresponding color is formed on the surface of each drum 1. The formed electrostatic latent image is developed as a toner image by the developing roller 42 of the developing unit 4.

By the electrophotographic image forming process operation such as described above, a Y color toner image corresponding to the yellow component of the full-color image is formed on the drum 1 of the first cartridge 7*a*. The toner image is primary transferred onto the belt 5 at the primary transfer portion T1 of the first cartridge 7*a*. An M color toner image corresponding to the magenta component of the full-color image is formed on the drum 1 of the second cartridge 7*b*. This toner image is primary transferred in superposition on the toner image of Y color already transferred onto the belt 5 at the primary transfer portion T1 of the second cartridge 7*b*. A C color toner image corresponding to the cyan component of the full-color image is formed on the drum 1 of the third cartridge 7*c*. This toner image is primary transferred in superposition on the toner images of Y color+M color already transferred onto the belt 5 at the primary transfer portion T1 of the third cartridge 7*c*. A K color toner image corresponding to the black component of the full-color image is formed on the drum 1 of the fourth cartridge 7*d*. This toner image is primary transferred in superposition on the toner images of Y color+M color+C color already transferred onto the belt 5 at the primary transfer portion T1 of the fourth cartridge 7*d*. A primary transfer bias having a predetermined potential and a polarity opposite to the charging polarity of the toner is applied at a predetermined control timing to each of the first to fourth primary transfer rollers 12 (12*a* to 12*d*). In this way, a four-color full-color unfixed toner image of Y color+M color+C color+K color is synthesized and formed on the moving belt 5. The unfixed toner image is conveyed by the subsequent rotation of the belt 5 and reaches the secondary transfer portion T2. In each cartridge 7, the surface of the drum 1 after the primary transfer of the toner image to the belt 5 is cleaned by removing the primary untransferred toner by the cleaning member 41 of the photosensitive member unit 6, and the cleaned belt surface is used in the next image forming step.

Meanwhile, one sheet of the recording material S in the feeding cassette 24 is fed by the feeding roller 9*a* and the retard roller 9*b* and conveyed to the registration roller pair 17 by the conveying roller pair 16 at a predetermined control timing. The recording material S is conveyed by the registration roller pair 17 to the secondary transfer portion T2 through a conveying path 15 at a predetermined control timing. A secondary transfer bias having a predetermined potential and a polarity opposite to the charging polarity of the toner is applied to the secondary transfer roller 18 at a predetermined control timing. As a result, in a process in which the recording material S is nipped and conveyed by the secondary transfer portion T2, the four-color superimposed toner image on the belt 5 is sequentially and completely secondary transferred to the surface of the recording material S. The recording material S leaving the secondary transfer portion T2 is separated from the belt 5 and conveyed to the fixing unit 14. Then, the toner image is fixed to the recording material S by heating and pressing while being nipped and conveyed by a fixing nip portion which is a pressure contact nip portion between a fixing member 14*a* and a pressing member 14*b* of the fixing unit 14. The recording material S leaving the fixing unit 14 is discharged to the discharge tray 20 by the discharge roller pair 19. The secondary untransferred toner remaining on the surface of the belt 5 after the secondary transfer of the toner image to the recording material S is removed from the belt surface by the transfer belt cleaning device 23, and the cleaned belt surface is used in the next image forming step. The toner removed by the transfer belt cleaning device 23 passes through a waste toner conveying path (not shown) and is conveyed to and collected in a waste toner collection container (not shown) arranged on the back side of the apparatus.

Process Cartridge Mounting Operation

As shown in FIG. 2B, in the image forming apparatus 100 of this example, each cartridge 7 is replaced by front access by opening the front door 21 which is an opening and closing member of the apparatus main body 100A. The reference numeral 21*a* denotes a grip portion disposed on the front door 21. The front-side frame 37 serving as a skeleton of the apparatus main body 100A is provided with an opening through which the cartridge is allowed to pass in order to attach and detach the cartridge 7. That is, the opening is provided for inserting the cartridge 7 into the cartridge mounting unit 22 in the apparatus main body 100A and for taking out the cartridge 7 from the cartridge mounting unit 22. The front door 21 is disposed in the apparatus main body 100A so as to be movable between a closed position in which the door is closed and covers the opening and an open position in which the opening is open.

FIGS. 5A to 5D are explanatory drawings illustrating the operations performed when the cartridge 7 is detached from and attached to the apparatus main body 100A.

Figure 5A:
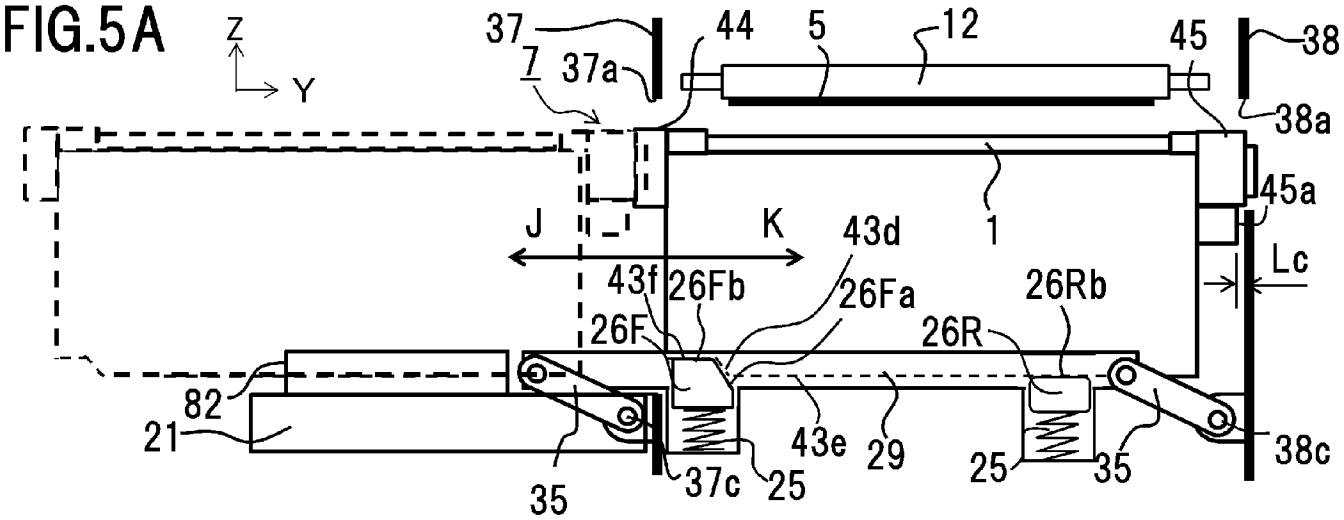
FIGS. 5A to 5D are conceptual explanatory drawings of a process cartridge mounting process in Example 1 of the present invention.

FIG. 5A is a view showing the operations performed when the cartridge 7 is slidingly unmounted from the apparatus main body 100A.

Figure 5B:
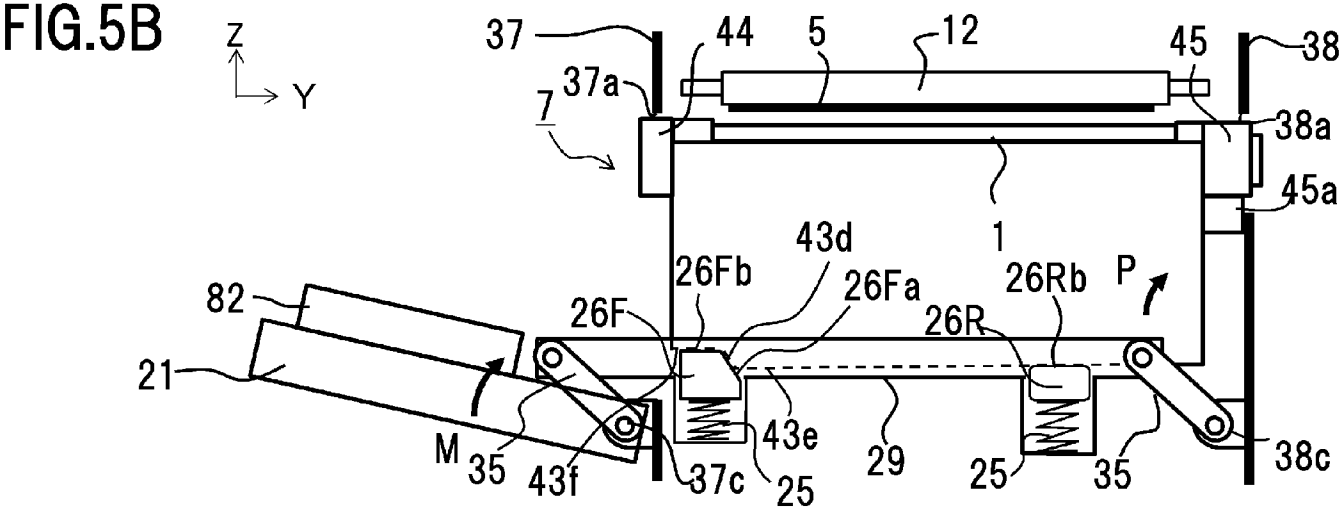

FIG. 5B is a view showing a state where the cartridge 7 is moved to the positioning position in the longitudinal direction as the user starts closing the front door 21.

Figure 5C:
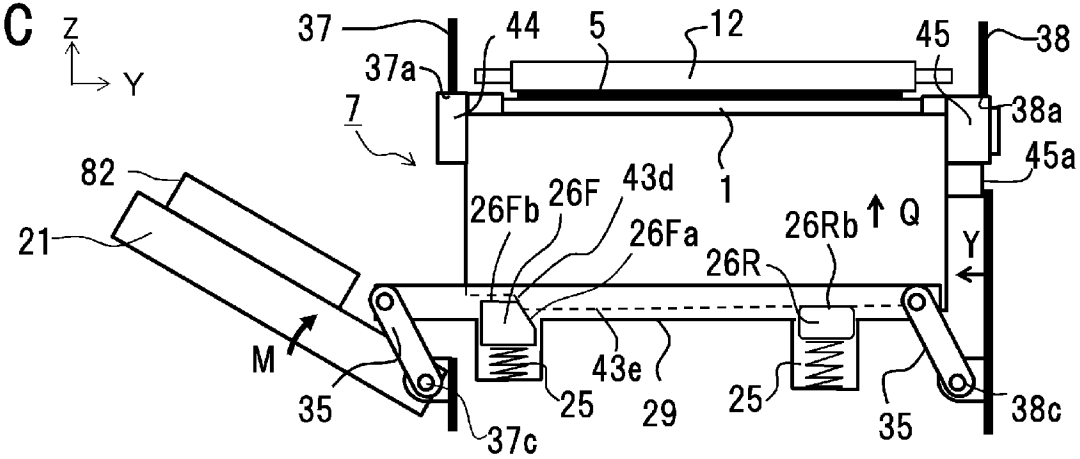

FIG. 5C is a view showing a state where the user further closes the front door 21 from the state shown in FIG. 5B, positions the cartridge 7 in the lateral direction (vertical direction in the drawing), and moves the cartridge to the positioning position where image formation is performed.

Figure 5D:
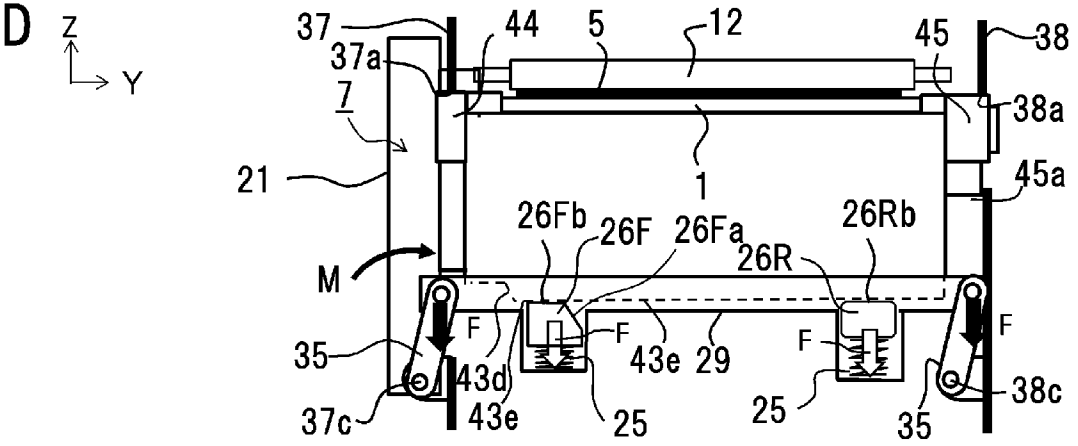

FIG. 5D is a view showing how the cartridge 7 is set under pressure to a state where an image can be formed in a state where a movable guide rail 29 is raised while the front door 21 is completely closed.

As shown in FIG. 5A, the cartridge 7 is inserted into the interior of the main body by sliding on the movable guide rail 29 in the direction of an arrow K in the drawing (the direction from the front side of the main body to the back side). A guide rib 43*b* is formed along the length of the cleaning frame 43 at the lower part of the cleaning frame 43 of the cartridge 7, and a guide projection 43*c* is formed at the upper part of the cleaning frame 43 (FIG. 4). The guide rib 43*b* is engaged with a guide groove portion 82 of the front door 21 and a guiding groove portion 29*g* of the movable guide rail 29 as a support member. The guide projection 43*c* is engaged with a guide groove portion 34 provided on the upper side of the cartridge mounting portion of the apparatus main body. These engagement configurations guide the insertion of the cartridge 7.

In the state shown in FIG. 5A, the cartridge 7 is pushed only to a position where it does not reach the positioning position in the longitudinal direction, that is, the cartridge is incompletely mounted, and a clearance Lc remains between the rear-side (back-side) frame 38 and an abutting portion 45*a* of the cartridge 7. Where positioning of the cartridge 7 in the lateral direction is performed in this state, since the innermost position in the longitudinal direction has not been reached, the connection of the electrical contacts or the drive coupling (not shown) is not satisfactorily achieved. The image forming apparatus according to the present example has, as a support unit, the movable guide rail 29 and a link mechanism including a rotating arm 35 and the like for connecting the movable guide rail 29 so that the movable guide rail can move relative to the frame of the apparatus main body. Such a support unit successively moves the cartridge 7 to a first position for positioning the cartridge 7 in the insertion direction K (first direction) of the cartridge 7 with respect to the apparatus main body and to a second position for positioning the cartridge in the K direction and in an orthogonal direction Q (second direction) orthogonal to the K direction. In the first position, the cartridge 7 is retracted from the position in which an image can be formed (the second position). The operation of the support portion is interlocked with the closing operation of the front door 21.

As shown in FIGS. 4 and 5, the movable guide rail 29 has, as a biasing portion, a pressure follower 26 (26F, 26R), which serves as an engaged portion, and a biasing member 25 on a support surface opposed to the lower surface of the cartridge 7. The pressure follower 26 is assembled as a pressure member so as to advance and retreat in a direction perpendicular to the support surface and is biased from below by the biasing member 25. In the cartridge 7, a pressurized surface 43*e* (second surface) corresponding to the lower surface of the guide rib 43*b* is supported by a pressure surface 26R*b* (second biasing surface) of the pressure follower 26R on the back side. Further, a pressurized surface 43*f* (first surface) on the front side with respect to the pressurized surface 43*e* is supported by a pressure surface 26F*b* of the pressure follower 26F on the front side.

The pressurized surface 43*f* is configured to be at a position (higher position) recessed from the pressurized surface 43*e*, and an engaging surface 43*d* (surface to be biased) which is an inclined surface connecting the pressurized surface 43*f* and the pressurized surface 43*e* is in a state of facing an inclined surface 26F*a* of the pressure follower 26F. That is, the cartridge 7 has, in the order of description in the insertion direction K, the pressurized surface 43*f* (first surface to be biased) extending in the insertion direction K, the engaging surface 43*d* (second surface to be biased) inclined in the insertion direction K and in the orthogonal direction Q, and the pressurized surface 43*e* (third surface to be biased) extending in the insertion direction K. These configurations correspond to the engaging portion in the present invention. Both the engaging surface 43*d* and the inclined surface 26F*a* extend in a direction (intersecting direction) opposite to the Z direction from the upstream side to the downstream side in the insertion direction.

Meanwhile, the pressure follower 26R on the back side is configured to have the pressure surface 26R*b* extending in the insertion direction K. Further, the pressure follower 26F on the front side has, in the order of description in the insertion direction K, the pressure surface 26F*b* (first biasing surface) extending in the insertion direction K and the inclined surface 26F*a* (second biasing surface) inclined in the insertion direction K and in the orthogonal direction Q. The state of biasing the cartridge 7 by the pressure follower 26F sequentially changes because the position of the pressure follower relative to the cartridge 7 is changed with the movement of the movable guide rail 29.

Further, as shown in FIG. 5B, when the closing operation of rotating the front door 21 in the direction of the arrow M is started, the movable guide rail 29 also starts to move and the inclined surface 26F*a* of the pressure follower 26F on the front side and the engaging surface 43*d* of the cartridge 7 abut against each other. The movable guide rail 29 is rotatably connected to and supported by four links constituted by a pair of front-side rotating arms 35 and a pair of back-side rotating arms 35 provided at the apparatus main body. The front-side rotating arms 35 are assembled with the front-side frame 37 so as to be rotatable around a rotation center 37*c*. The back-side rotating arms 35 are assembled with the back-side frame 38 so as to be rotatable around a rotation center 38*c*. The rotation centers 37*c*, 38*c* are parallel to each other, and the arms 35 rotate so as to maintain the same angle. As a result, the movable guide rail 29 moves from the front side to the back side so as to remain parallel to the horizontal direction (parallel movement), while the height thereof is raised. As a consequence, the cartridge 7 moves in the interior of the apparatus main body along the same trajectory P as the rotational trajectory M of the rotating arm 35 in conjunction with the rotation of the front door 21. Then, the cartridge reaches a position (first position) in which the abutting portion 45*a* abuts against the back-side frame 38 which is the longitudinal positioning portion (first positioning portion) of the cartridge 7. As a result, the position of the cartridge 7 in the longitudinal direction (first direction) which is the direction of the arrows J and K (the front-rear direction of the apparatus) is determined by the abutment with the side surface (regulation surface) extending in the Z direction (direction intersecting the insertion direction of the cartridge) of the back-side frame 38. Until the cartridge 7 reaches the first position, the pressure follower 26F is in a state (first biasing state) in which the pressure surface 26F*b* is in contact with the pressurized surface 43*f*, the inclined surface 26F*a* is in contact with the engaging surface 43*d*, and a biasing force is exerted on the cartridge 7. At this time, the front door 21 and the rotating arms 35 rotate coaxially about the rotation center 37*c* with a constant phase angle. Further, the inclined surface 26F*a* of the pressure follower 26F and the engaging surface 43*d* of the cartridge 7 are set at an angle of about 60° with respect to the insertion and removal direction (K direction in FIG. 5A).

Furthermore, as shown in FIG. 5C, when the front door 21 is rotated, the cartridge 7 moves in the vertical direction (direction of the arrow Q in the drawing). Then, the bearing members 44, 45 at the front and rear of the cartridge 7 reach a position (second position) where they abut against the front-side frame 37 and the back-side frame 38 (second positioning portion). The position of the cartridge 7 in the lateral direction (second direction) which is the direction of the arrow Q (height direction of the apparatus, vertical direction) is thus determined. The abutting portions 37*a*, 38*a* of the front-side frame 37 and the back-side frame 38 as the second positioning portions are edge surfaces of a metal plate edge having a V-like shape when viewed in the longitudinal direction, and a large frictional force acts on the cartridge 7 in the longitudinal direction when the cartridge abuts against the edge end surface. As a result, the cartridge 7 is prevented from moving to the front side of the main body even when the cartridge receives a reaction force created by an electrical contact or a drive coupling (not shown) in the longitudinal direction (Y direction in the drawing) of the cartridge. At this time, the pressure follower 26F is in a state (second biasing state) in which the inclined surface 26F*a* is in contact with the engaging surface 43*d* and a biasing force is exerted on the cartridge 7.

Finally, as shown in FIG. 5D, in the operation until the front door 21 is closed (reaches the closed position), the movable guide rail 29 further rotates from the state shown in FIG. 5C. Since the cartridge 7 is set at the positioning position and does not move, the movable guide rail 29 further moves to the back side of the apparatus while causing the cartridge 7 to slide on the support surface (shifting the support position of the cartridge 7). In the course of this movement, the inclined surface 26F*a* of the pressure follower 26F moves so as to slide with respect to the engaging surface 43*d* of the cartridge 7 and is pushed downward, and the supported surface of the cartridge 7 which is supported by the pressure surface 26F*b* changes from the supported surface 43*f* to the supported surface 43*e*. That is, the engagement of the engaging portion between the inclined surface 26F*a* of the pressure follower 26F and the engaging surface 43*d* of the cartridge 7 is released. When the engagement in the longitudinal direction of the pressure follower 26F is released, the pressurized surface 43*e*, which is the lower surface of the cartridge 7, pushes down the pressure followers 26F, 26R. As a result, a pushing member 25 as a biasing member, such as a spring, that supports the pressure followers 26F, 26R is compressed and a pressing force (biasing force) is generated to press the pressure followers 26F, 26R against the pressurized surface 43*e* so as to position the cartridge 7 in the lateral direction. The pressure follower 26F is in a state (third biasing state) in which the pressure surface 26F*b* is in contact with the pressurized surface 43*e*, the inclined surface 26F*a* is in contact with the engaging surface 43*d*, and a biasing force is exerted on the cartridge 7. This state is the final positioning state of the cartridge 7, and the image forming operation is performed in this state.

In the above-described mounting of the cartridge 7, the user does not need a large operation force when operating the front door 21. The rotation radius of the front door operating portion 21*a* is sufficiently larger than the link radius (the distance from the rotation center of the rotating arm 35 to the joint between the rotating arm 35 and the movable guide rail 29) of the rotating arm 35. Therefore, it is possible to apply the pushing force or pressing force in the longitudinal direction of the cartridge 7 with a very light operation force due to this leverage ratio. This example relates to a tandem image forming apparatus that forms a color image and is provided with four cartridges. However, an actuation force for positioning four cartridges at the same time can be obtained without requiring the user to apply a large operation force when opening the front door 21.

Further, a moment acts in a direction in which the front door 21 closes with respect to the rotation center 37*c* of the front door 21, with a reaction force F received by the pressure followers 26F, 26R being a force F applied to the rotating arm 35. That is, in the joint between the rotating arm 35 and the movable guide rail 29, the moment about the rotation center 37*c* of the rotating arm 35 acts so as to reduce the biasing force of the pressing member 25. The direction in which such a moment acts coincides with the direction (closing direction) of the moment acting on the operating portion 21*a* in the closing operation of the front door 21. Due to this moment, the movable guide rail 29 moves in the direction opposite to the Q direction relative to the cartridge 7. As a result, the compression of the pressing member 25 is relieved and the biasing force by the pressing member 25 is reduced. Therefore, by utilizing the moment generated by the pressing force of the cartridge 7, the force for closing the front door 21 is assisted, and the user operation force for opening and closing the front door 21 is reduced.

In the case of removing the cartridge 7 from the apparatus main body, operations are performed in reverse to those described above with reference to FIGS. 5A to 5D. Detailed description of the removal operation is herein omitted.

As described above, according to the present example, positioning and mounting of the cartridge can be performed without using a large operation force with respect to the reaction force in the mounting direction created by the interface configuration of the cartridge and the apparatus main body, such as the drive coupling or electrical contacts on the rear side of the cartridge and waste toner conveying coupling. That is, the operation force for mounting the cartridge 7 can be reduced with respect to that in the conventional configuration, without increasing the cartridge drawing-in force by a thrust spring or the like as in the above-described conventional configuration.

Further, according to the present example, the cartridge is reliably positioned to the positioning position in the longitudinal direction even in an insufficiently mounted state where the cartridge 7 is not inserted by the user to the innermost longitudinal positioning position. Therefore, it is possible to prevent problems such as a connection failure of the drive coupling and poor contact of the electrical contacts and to provide a highly reliable cartridge positioning mechanism. That is, according to the present example, it is possible to provide an image forming apparatus that allows the user to operate the cartridge with a small operation force and reliably set the cartridge to the positioning position when the cartridge of the image forming apparatus is mounted.

Example 2

Figure 6A:
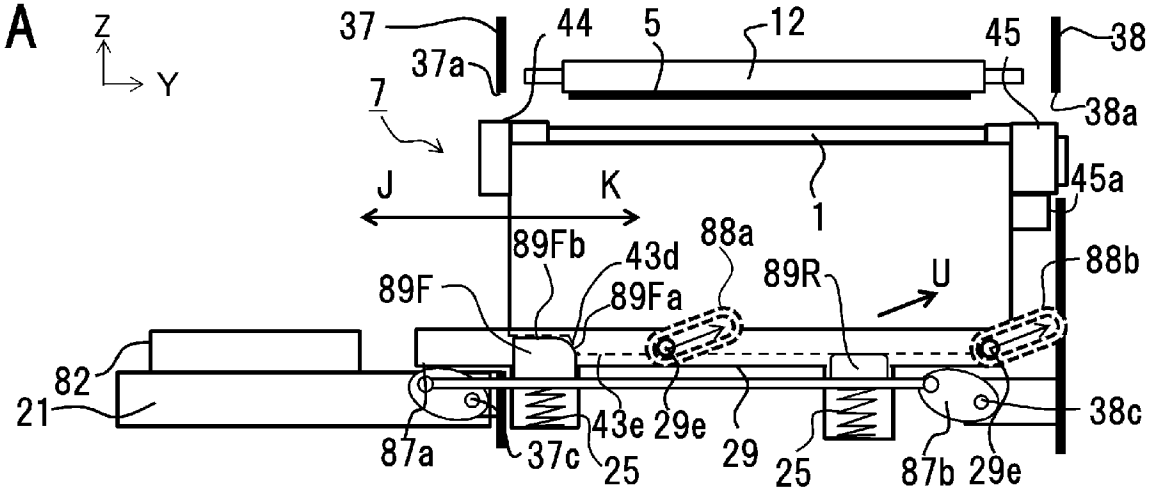
FIGS. 6A and 6B are conceptual explanatory drawings of a process cartridge mounting process in Example 2 of the present invention.
Figure 6B:
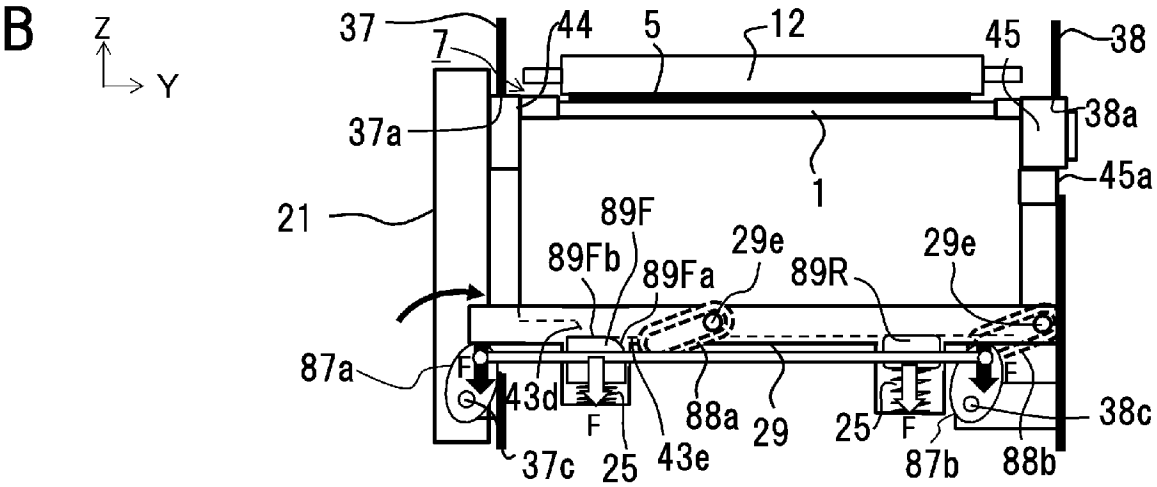

An image forming apparatus according to Example 2 of the present invention will be described with reference to FIGS. 6A and 6B. In the configuration of Example 2, the same components as in Example 1 are denoted by the same reference numerals, and the redundant explanation thereof is herein omitted. FIGS. 6A and 6B are schematic structural cross-sectional views of a cartridge and an apparatus main body at the time of mounting the cartridge of the image forming apparatus of Example 2.

As shown in FIG. 6A, the cartridge 7 is slid on the guide rail 29 in the backward direction of the arrow K and inserted into the main body in the same manner as in Example 1. As shown in the figure, in Example 2, a cam mechanism is provided such that cams 87 (87*a*, 87*b*) which are together interlocked by a link to the front door 21 are provided to be interlocked to the front side and the back side of the main body and are configured to lift the movable guide rail 29 from below. At this time, bosses 29*e* of the movable guide rail 29 are slidably guided by slide guides 88 (88*a*, 88*b*) fixedly installed at the main body frame. Therefore, when the front door 21 is turned and closed, the displacement amount of the movable guide rail 29 caused by the cams 87 corresponds to the movement in the direction along the slide guides 88. As a result, positioning in the lateral direction is performed after the cartridge 7 has been positioned in the longitudinal direction, in the same manner as in Example 1, and a transition is made to the state shown in FIG. 6B.

The movable guide rail 29 in the present example includes a cam follower 89F on the front side of the apparatus main body and a cam follower 89R on the back side of the apparatus main body as members corresponding to the pressure followers 26F, 26R in Example 1. The cam follower 89F on the front side of the apparatus main body has a shape including a pushing surface 89F*b* perpendicular to the pressing direction (vertical direction in the drawing) and a curved portion 89F*a* on the back side of the apparatus main body. When the movable guide rail 29 moves in a U direction in the figure, the engaging surface 43*d* of the cartridge 7 engages with the curved portion 89F*a* of the pressure follower 89F to move the cartridge to the positioning position in the longitudinal direction. Where the movable guide rail 29 further moves and positioning is performed to the positioning portion in the lateral direction of the cartridge, the engaging surface 43*d* of the cartridge 7 slides along the curved portion 89F*a* of the pressure follower and the engagement thereof is released. Then, the biasing state changes to a state where the pressurized surface 43*e* of the cartridge is pushed only by the pushing surface 89F*b*.

As described above, in Example 1, the shape of the engaged portion between the pressure follower and the cartridge is such that the inclined surfaces are engaged with each other, but this shape is not limited to inclined surfaces and, as in Example 2, a configuration in which either of the surfaces is an inclined surface whereas the other is not an inclined surface can be used. For example, the same effect can be achieved when the other surface is of a curved surface shape such as a circular arc shape.

The configuration is such that even in the state shown in FIG. 6B, similarly to Example 1, as a result of the cam 87 receiving the reaction force of the pressure force received from the cartridge 7, a moment in the direction of closing the front door acts on the rotation center 37*c* of the front door 21. That is, the moment about the rotation center 37*c* of the cam 87 acts on the contact point between the cam 87 and the movable guide rail 29 so as to reduce the biasing force of the pressing member 25. The direction in which such a moment acts coincides with the direction (closing direction) of the moment acting on the operating portion 21*a* in the closing operation of the front door 21. Therefore, the same effect as in Example 1 can be obtained. With the above-described configuration, the effect similar to that in Example 1 can be obtained in Example 2, and the same effect can be expected with a comparatively simple configuration.

Further, the shapes of the pressure follower 89F and the cartridge 7 which are to be engaged in the longitudinal direction are not limited to those described in the examples. Thus, as long as a contact angle in the engaging portion of the pressure follower and the cartridge is formed so that a force pushing down the pressure follower acts after the longitudinal positioning of the cartridge has been performed, other shapes and configurations can be used as appropriate and it can be expected that the same effect will be demonstrated.

Other Embodiment

In the configuration of Example 1, where the closing operation for rotating the front door 21 in the direction of the arrow M is started, the movable guide rail 29 also starts to move, and the inclined surface 26F*a* of the pressure follower 26F on the front side and the engaging surface 43*d* of the cartridge 7 abut against each other. However, such a configuration is not limiting. For example, a configuration may be used in which the inclined surface 26F*a* and the engaging surface 43*d* are biased when the inclined surface 26F*a* of the pressure follower 26F on the front side and the engaging surface 43*d* of the cartridge 7 come into contact with each other and the closing operation of the front door 21 is started as a result of the cartridge 7 being inserted into the apparatus main body 100A.

Further, in the above-described examples, the color electrophotographic image forming apparatus and cartridge of the contact developing method have been described by way of example. However, the present invention can also be applied to a monochrome electrophotographic image forming apparatus, a non-contact developing system, or a developing unit mountable on the apparatus main body and a developer unit having a developer.

Further, in the above-described examples, the cartridge has a photosensitive drum and at least one process means. Examples of the process means include charging means, developing means, and cleaning means. Therefore, the cartridge is a configuration obtained by integrating the charging means, the developing means or the cleaning means with the photosensitive drum, and this cartridge can be detachably attached to the apparatus main body. Alternatively, at least one of the charging unit, the developing unit, and the cleaning unit may be integrated with the photosensitive drum to form a cartridge to be detachably attached to the apparatus main body. Further, at least the developing means and the photosensitive drum may be integrated into a cartridge to be detachably attached to the apparatus main body.

In addition, the cartridge to which the present invention can be applied includes, for example, a toner cartridge which is a container filled with toner and configured to be detachably attached to the apparatus main body separately from the above-mentioned process means and photosensitive drum. Further, the electrophotographic image forming apparatus forms an image on a recording material by using an electrophotographic image forming method. Examples of the electrophotographic image forming apparatus include an electrophotographic copying machine, an electrophotographic printer (for example, a laser beam printer, an LED printer, and the like), a facsimile machine, a word processor, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-213277, filed Oct. 31, 2016, which is hereby incorporated by reference herein in its entirety.

What is claimed is:

1. An image forming apparatus comprising:

a cartridge including a rotating member; and an apparatus main body to which the cartridge is detachably attached in a first direction which is parallel to a direction along a rotational axis of the rotating member, the apparatus main body including:

a positioning portion configured to be contacted with the cartridge thereby to determine a position of the cartridge in the first direction; and a support unit configured to support the cartridge from below and to move the cartridge, in a second direction intersecting the first direction, between a first position and a second position, the second position being a position in which an image forming can be performed, the first position being a position in which the cartridge is retracted from the second position, wherein the cartridge has an engaging portion that is configured to engage with the support unit, the engaging portion including a biased surface which is downwardly inclined toward a downstream end of the cartridge in the first direction, wherein the support unit has an engaged portion which is to be engaged with the engaging portion of the cartridge and is provided upstream of the positioning portion in the first direction and has an elastic member biasing the engaged portion in the second direction, the engaged portion including a biasing surface which is downwardly inclined toward the positioning portion in the first direction, and wherein while the support unit moves the cartridge from the first position toward the second position, the biased surface of the cartridge is biased by the biasing surface of the support unit so that the cartridge is moved toward the positioning portion in the first direction, and when the cartridge is positioned in the second position, the cartridge contacts with the positioning portion and the biased surface of the cartridge is positioned upstream of the biasing surface of the support unit in the first direction so as not to contact with the biasing surface of the support unit.

2. The image forming apparatus according to claim 1, wherein when the engaged portion, the biasing surface, and the elastic member are an upstream engaged portion, an upstream biasing surface, and an upstream elastic member, respectively, the support unit further includes a downstream engaged portion that has a downstream biasing surface extending in the first direction and includes a downstream elastic member biasing the downstream engaged portion in the second direction, the downstream engaged portion being provided downstream of the upstream engaged portion in the first direction, wherein when the engaging portion and the biased surface are an upstream engaging portion and an upstream biased surface, respectively, the cartridge further includes a downstream engaging portion that has a downstream biased surface extending in the first direction, the downstream engaging portion being provided downstream of the upstream engaging portion in the first direction, and wherein while the support unit moves the cartridge from the first position toward the second position, the downstream biased surface of the cartridge is biased by the downstream biasing surface of the support unit, and when the cartridge is positioned in the second position, the downstream biased surface of the cartridge is biased by the downstream biasing surface of the support unit.

3. The image forming apparatus according to claim 1, wherein when the biasing surface is a first biasing surface, the engaged portion of the support unit further has a second biasing surface extending in the first direction, the second biasing surface being arranged adjacent to an upstream side of the first biasing surface in the first direction, wherein when the biased surface is a first biased surface, the engaging portion of the cartridge further has a second biased surface extending in the first direction, the second biased surface being arranged adjacent to a downstream side of the first biased surface in the first direction, and wherein when the cartridge is positioned in the second position, the second biased surface of the cartridge is biased by the second biasing surface in the second direction.

4. The image forming apparatus according to claim 1, wherein the apparatus main body includes:

an opening through which the cartridge passes when the cartridge is attached to the apparatus main body; and an opening and closing member configured to be movable between an opening position in which the opening and closing member opens the opening and a closing position in which the opening and closing member closes the opening, and wherein the support unit moves the cartridge from the first position to the second position, in conjunction with a movement of the opening and closing member from the opening position to the closing position.

5. The image forming apparatus according to claim 1, wherein the rotating member is a photosensitive drum bearing a toner image, and the apparatus main body further includes an intermediate transfer member to which the toner image borne on the photosensitive drum is transferred, and wherein in a case where the cartridge is in the second position, the photosensitive drum contacts with the intermediate transfer member, and in a case where the cartridge is in the first position, the photosensitive drum is apart from the intermediate transfer member.

6. An image forming apparatus comprising:

a cartridge including a rotating member; and an apparatus main body to which the cartridge is detachably attached in a first direction which is parallel to a direction along a rotational axis of the rotating member, the apparatus main body including:

a positioning portion configured to be contacted with the cartridge thereby to determine a position of the cartridge in the first direction; and a support unit configured to support the cartridge from below and to move the cartridge, in a second direction intersecting the first direction, between a first position and a second position, the second position being a position in which an image forming can be performed, the first position being a position in which the cartridge is retracted from the second position, wherein the cartridge has an engaging portion, provided on an upstream end portion of the cartridge in the first direction, that is configured to engage with the support unit, the engaging portion including a biased surface which is downwardly inclined toward a downstream end portion of the cartridge in the first direction, wherein the support unit has an engaged portion which is to be engaged with the engaging portion of the cartridge and is provided upstream of the positioning portion in the first direction, and has an elastic member biasing the engaged portion in the second direction, the engaged portion including a biasing surface which is downwardly inclined toward the positioning portion in first direction, and wherein while the support unit moves the cartridge from the first position toward the second position, the biased surface of the cartridge is biased by the biasing surface of the support unit so that the cartridge is moved toward the positioning portion in the first direction.

7. The image forming apparatus according to claim 6, wherein when the engaged portion, the biasing surface, and the elastic member are an upstream engaged portion, an upstream biasing surface, and an upstream elastic member, respectively, the support unit further includes a downstream engaged portion that has a downstream biasing surface extending in the first direction and includes a downstream elastic member biasing the downstream engaged portion in the second direction, the downstream engaged portion being provided downstream of the upstream engaged portion in the first direction, wherein when the engaging portion and the biased surface are an upstream engaging portion and an upstream biased surface, respectively, the cartridge further includes a downstream engaging portion that has a downstream biased surface extending in the first direction, the downstream engaging portion being provided downstream of the upstream engaging portion in the first direction, and wherein while the support unit moves the cartridge from the first position toward the second position, the downstream biased surface of the cartridge is biased by the downstream biasing surface of the support unit.

8. The image forming apparatus according to claim 6, wherein when the biasing surface is a first biasing surface, the engaged portion of the support unit further has a second biasing surface extending in the first direction, the second biasing surface being arranged adjacent to an upstream side of the first biasing surface in the first direction, wherein when the biased surface is a first biased surface, the engaging portion of the cartridge further has a second biased surface extending in the first direction, the second biased surface being arranged adjacent to a downstream side of the first biased surface in the first direction, and wherein when the cartridge is positioned in the second position, the second biased surface of the cartridge is biased by the second biasing surface in the second direction.

* * * * *